United States Patent [19]

Gates

[11] 4,045,897

[45] Sept. 6, 1977

[54] COHESIVE DISPLAY BOARD

[76] Inventor: Victor Genez Gates, 1342 Harvard, Santa Monica, Calif. 90404

[21] Appl. No.: 681,584

[22] Filed: Apr. 29, 1976

[51] Int. Cl.[2] ..... G09F 1/00

[52] U.S. Cl. ..... 40/125 A; 40/142 R; 35/7 R

[58] Field of Search ..... 40/125 A, 160, 140, 40/142 R, 129 A, 2 R, 2.2, 1.5; 35/7 R

[56] References Cited

U.S. PATENT DOCUMENTS

| | | | |
|---|---|---|---|
| 3,063,749 | 11/1962 | Struble et al. | 40/125 A |
| 3,094,330 | 6/1963 | Smith | 40/125 A |
| Re. 19,238 | 7/1934 | Burke | 40/125 A |

FOREIGN PATENT DOCUMENTS

| | | | |
|---|---|---|---|
| 1,267,373 | 6/1961 | France | 40/125 A |

*Primary Examiner*—E. H. Eickholt
*Attorney, Agent, or Firm*—Dennis L. Mangrum

[57] ABSTRACT

The present invention is a new structure for a cohesive display board. The surface of the display board is treated with flocking, powdered rayon, as is the back of the item to be displayed. Contact of the flocking, on the display item and display board, will cause the display item to adhere to the display board. The cohesive force is created by the interlocking or meshing of the contiguous fiberous rayon flocking.

6 Claims, 5 Drawing Figures

Fig. 1
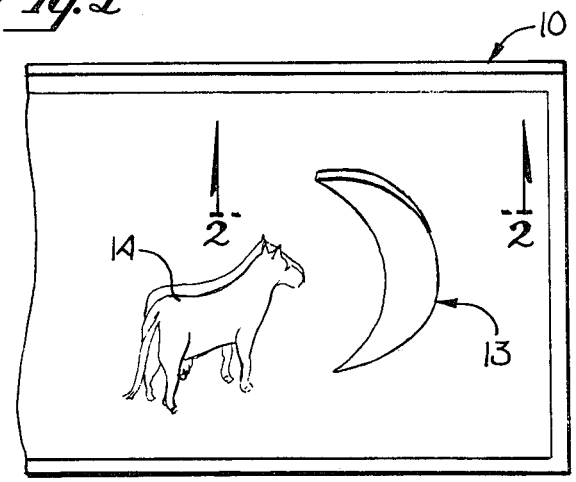
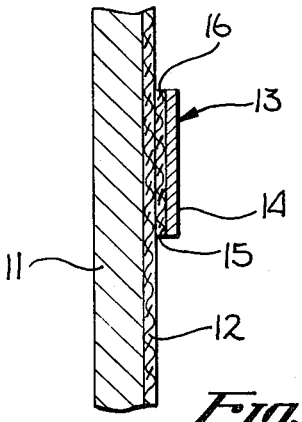
Fig. 2
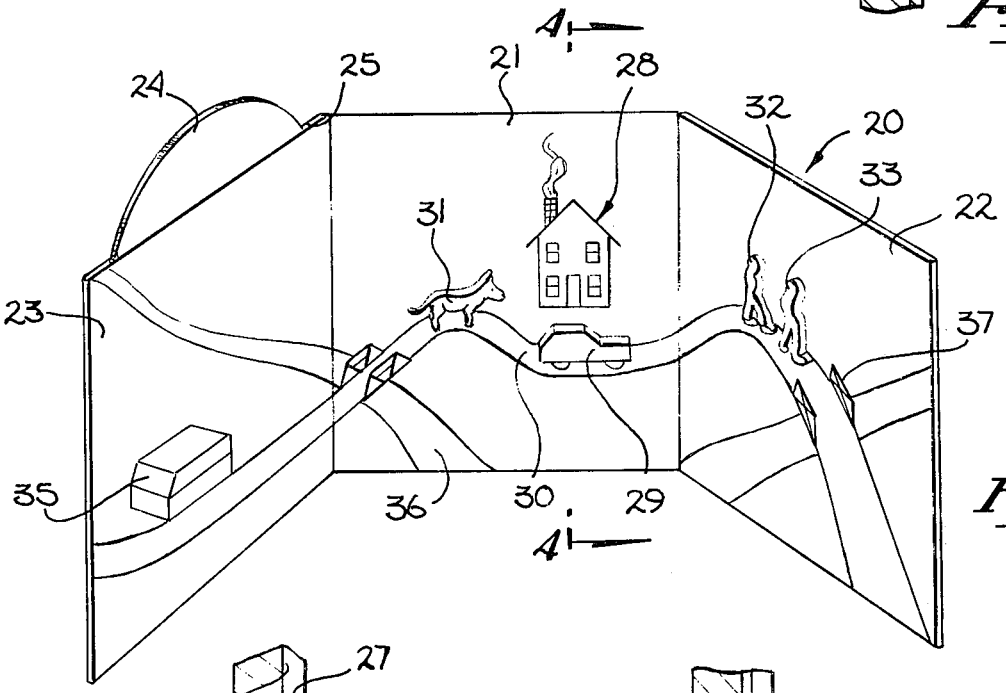
Fig. 3
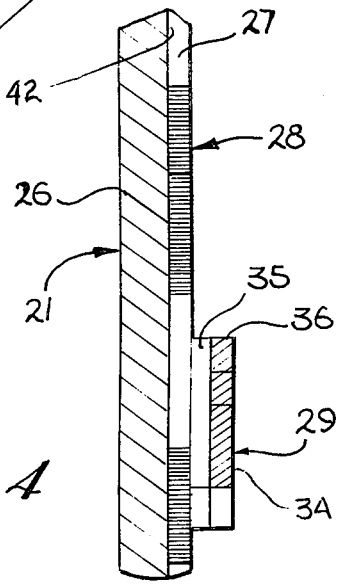
Fig. 4
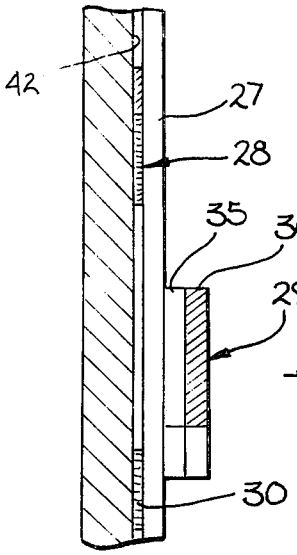
Fig. 5

COHESIVE DISPLAY BOARD

BACKGROUND OF THE INVENTION

1. Field of the Invention

This invention relates to a new structure for a cohesive display board.

2. Prior Art

Display boards on which items of interest may be displayed to a particular audience are well known in the prior art. Some of these display board are made from cork or other porous material and items to be displayed are secured thereto by positive mechanical fasteners such as pins, thumbtacks, etc. These types of display boards are normally used in homes, business and public places for notices, bulletins and/or information. Items secured thereto can be removed and new items afixed by removing and re-using the mechanical fastener. Another class of display boards do not use mechanical fasteners but are used where permanency is not required. The primary benefit of this display board is the ease of placing and removing the display items. The most typical display board in this class is commonly known as a flannel board. This class of display board is most frequently used in lecturing or story telling and may be used in various amusement activities.

Flannel boards in the prior art are well known. A flannel board is normally comprised of a flat plate to which a piece of flannel, felt, or other suitable material is secured. The objects to be displayed also have disposed on their back a piece of material such as flannel, felt or other suitable alternative material. The item to be displayed can be attached to the display board by simply placing it on the board, in any location, and by gently rubbing the display item. The display item will adhere to the board because of the interlocking of the fibers of the opposing strips of material. The display item will remain in position on the display board and can be easily removed. These prior art flannel boards are very effective for their particular uses. It has been found that many types of cloth material are suitable in the fabricating of a flannel board, the better being previously mentioned, ie. felt or flannel.

This class of cohesive display boards have specific problems which result from the use of these cloth fabrics. In use the nap of the flannel material wears out, becomes depressed or dirty. The display items which are to be displayed will not adhere when the nap wears. This problem cannot be avoided, flannel boards when employing cloth material simply wear out.

Flannel boards of the prior art pose other problems and have other deficiencies. One particular requirement is that the flannel material and plate must be relatively flat and the item to be displayed cannot be warped or bent, since any uneveness in the contact areas will substantially effect the cohesive force. Another requirement is that the prior art flannel boards can not normally be held in the verticle position since there is not sufficient cohesive force existing between the two fabrics. Large objects can not be displayed since the gravational force will exceed the cohesive force and cause the object to fall.

Still another problem with the prior art flannel boards is that the back of the display item must have a strip of flannel or felt or other suitable material secured thereto. The commercial manufacturer must make the backing strips in some uniform pattern in order to be commercially marketable. On the other hand, the user fabricates display items to fit his particular needs. The needs may not meet any commercial size and shape patterns and hence the user is forced to cut tape and piece. Additionally it is beneficial to cover a large area of the back of the display item with the flannel material to create greater surface area contact and greater cohesive force. Covering of the surface of the display item is often difficult to do whether commercially made backings are used or not. In other instances the display items are either small or have intricate patterns which do not lend themselves to have secured thereto a piece of backing. It is sometimes difficult to secure to the back of some display items sufficient material to create the cohesive bond to secure the display item in place on the display board, and often the backing projects from the sides of the display items or may be exposed among internal cutouts of the display item and partially destroy the effect of the item to be displayed.

The present invention overcomes the above problems by providing new structure and a new method for forming a cohesive type of display board which is safe, easy and economical to fabricate.

SUMMARY OF THE INVENTION

A new improved structure for a cohesive display board is disclosed. The invented structure includes a display board, and a display item each of which have one side coated with flocking, powdered rayon. When the coated sides of the display item and display board are contiguous a cohesive force is created therebetween and the display item will adhere to the display board.

It is an object of the present invention to provide a cohesive display board on which display items can be easily placed in any position and also be easily removed.

It is another object of the present invention to provide a cohesive display board which will not easily wear out or become inefficient through use.

It is still another object of the present invention to provide display boards which can utilize display items of various configurations.

It is another object of the present invention to provide a cohesive reusable display board and display items.

BRIEF DESCRIPTION OF THE DRAWING

FIG. 1 is a front view of a display board of the present invention having several display items adhering thereon;

FIG. 2 is a cross sectional view taken along line 2—2 of FIG. 1;

FIG. 3 illustrates the use of the present invention employed on a folding panelled record album;

FIG. 4 is a cross sectional view taken along line 4—4 of FIG. 3;

FIG. 5 is a cross sectional view taken along line 4—4 of FIG. 3 illustrating an alternate embodiment.

DETAILED DESCRIPTION OF A PREFERRED EMBODIMENT

The present invention relates to display boards of all kinds on which display items can be placed and easily removed. The particular feature common to display boards of this type is the cohesive force created between the item to be displayed and the display board. The cohesive force derives from the intermeshing or interlocking of the nap of the material on the respective surfaces of the display item and display board. Boards of these kind are typically referred to as flannel boards and a cloth material having a fine nap such as felt or flannel is used on the adjoining surfaces of the display board and display item.

Referring first to FIG. 1 a typical display board 10 is shown. The display board 10 can be used in conjunction with lecturing, story telling, game playing, story album read alongs or for general amusement and display. In FIG. 1 the display board 10 is shown wherein two FIGS. 13 and 14 are shown disposed thereon. The display board 10 is normally fabricated from a rigid or semi-rigid flat plate 11. One side of flat plate 11 is coated with flocking (powdered rayon). Powdered rayon is a substance well known in the prior art and is used very frequently in several applications. The most frequent usage of powdered rayon is as a decorative relief surface for greeting cards, Christmas cards and the like. It is also used to cover ceramic materials for decorative reasons. To the touch the powdered rayon feels fuzzy and protrudes from the surface. Powdered rayon is manufactured by many companies, one such company being S. L. Abbot of Los Angeles, Calif.

The powder rayon may be applied to the flat plate 11 in many different manners all of which are well known in the prior art, but may include repetitive steps of gluing, sprinkling and/or spraying. The only requirement being that any of the surface of the display board which is to be used for display be coated with the powdered rayon. It should be noted that the present invention permits and contemplates random or patterned coating of the powdered rayon onto the display board for the purpose of making only portions of the display board capable of being used for display.

The present invention requires that the back of the display items also be treated or covered with the powdered rayon. In FIG. 2 the display item 13 is shown having a front colored face 14 and a back 15 on which powdered rayon 16 is disposed. The rayon 16 can be disposed on the display items 13 and 14 in a manner similiar to that used to coat the surface of the flat plate 11. Once both the display item and display board are coated with the powdered rayon the display item will adhere easily to the display board by simply placing the display item 13 and 14 contiguous to any portion of the display board 10 coated with powdered rayon 12.

It should be noted that this particular manner of coating the display items solves many problems present in the prior art. For example, in most uses the display item is not formed at the same time or at the same place as the display board. Producers normally include with the display board strips of material which can be glued to the back of the display item. These strips are normally fabricated in specific sizes and when they are applied to many display items they either protrude from the edges, protrude from interior cutouts or are of not sufficient size to create enough cohesive force to hold the display item on the display board. The present invention permits a user to manufacture his own display items and simply put glue on the back side of the display item and sprinkle the powdered rayon over the coated surface. This permits many items to be used without any undue or unsightly strips protruding and also permits sufficient material to be disposed on the back of the display item to create sufficient cohesion.

The present invention has many beneficial features not known or taught in the prior art. For instance the cloth material normally used to cover the surface of the display board has a nap which wears out through use and gradually deteriorates. With use the cohesive force created between the display item and display board lessens. The present invention provides a new structure and substance which is easily manufactured and can be disposed on both the display board and display item with ease. It has a very long life and with proper care the cohesive force will continue until the powdered rayon is completely worn from flat plate 11.

The display board of the present invention can be used in varied applications. A particular useful application is shown in FIG. 3. There, a record album 20 having a story record 24, permits the listener to listen to the story while following a visual representation illustrated on the album cover 21, 22 and 23. The story characters are display items 29, 31, 32 and 33 and can be moved across the album cover.

The record album in the present case is comprised of three typical fold out panels 21, 22 and 23. A typical panel 21 is described hereinafter. Many methods exist for fabricating the panel, two of which are described hereinafter it being understood that such fabrication is only an example of the preferred form. The record album 20 is formed from cardboard 26 or other semi-rigid material. The flocking 27 is disposed on surface 26 by being glued, sprayed or otherwise as previously described. In this particular application different story objects on the display board are formed from different colors of powdered rayon. For instance, house 28, stream 36, bridge 37, building 35 and road 30 are formed on the album cover in various colors as is the remainder of the illustration. The display items 29, 31, 32 and 33 may be fabricated from any type of material and can have many types of visual surfaces 34. The back side of the display items are coated with the flocking as previously described. This permits the display items to be placed on various portions of the record album and stick thereto due to the cohesive force existing between the two contiguous layers of powdered rayon.

In another embodiment, FIG. 5, the illustrations 28, 35, 36 and 37 on the record album 20 are painted directly thereon as illustrated in FIG. 5. A clear or white coating 27 of powdered rayon is then formed over the illustration. This permits the entire surface to be covered with a uniform coating of the powdered rayon while permiting the background colors and illustrations to show therethrough. The display items are formed as in the previously described embodiment and the display items can be easily moved on and over the album 21 as the story is told.

The presently preferred form of the present invention has been described using powdered rayon as the flocking. It should be understood however, that any powdered fiberous synthetic material could be used and this invention is not limited to solely the use of rayon. The invention contemplates the intermeshing of the fibers of the powdered synthetic material to create the cohesive force for the display board.

The present invention has been described in particular reference to several embodiments wherein display boards are used for different purposes. The present invention is not limited to simply those two applications but to any application where a cohesive display board as contemplated by this invention is employed. However, while the preferred embodiment of the present invention has been described in detail herein, it will be understood by those skilled in the art that various changes in form and detail may be made therein without departing from the spirit and scope of the invention.

I claim:

1. A display board comprising:

a. a surface being at least partially coated with a powdered synthetic fiberous material;

b. at least one display item having at least one side coated with a powdered synthetic fiberous material for selectively engaging portions of said partially coated surface;

whereby, said display item may be displayed by disposing said display item on the coated portion of said surface such that said fiberous material on said display item engages at least a part of said coated portion of said surface.

2. The display board of claim 1 wherein said powdered synthetic fiberous material is rayon.

3. The display board of claim 1 wherein said partially coated surface is comprised of different colored and patterned segments of powdered synthetic fiberous material.

4. A display board comprising:

a. a surface having a predetermined design thereon, said perdetermined design being at least partially formed from a powdered synthetic fiberous material;

b. at least one display item having at least one side coated with a powdered synthetic fiberous material, for selectively engaging portions of said predetermined design;

whereby said display item may be selectively disposed on said surface in at least one predetermined position relative to said predetermined design by being disposed such that said fiberous material on said display item engages at least a part of said fiberous portion of said predetermined design.

5. The display board of claim 4 wherein said predetermined design is comprised of different colored powdered synthetic fiberous material.

6. The display board of claim 4 wherein said powdered synthetic fiberous material is rayon.

* * * * *